US005626372A

United States Patent [19]

Vogt

[11] Patent Number: 5,626,372

[45] Date of Patent: May 6, 1997

[54] ENGAGEABLE AND DISENGAGEABLE SAFETY LATCH

[76] Inventor: Peter A. Vogt, 29256 Kestrel La., Laguna Niguel, Calif. 92677

[21] Appl. No.: 540,564

[22] Filed: Oct. 6, 1995

[51] Int. Cl.[6] ..... E05L 19/06

[52] U.S. Cl. ..... 292/87; 292/DIG. 65

[58] Field of Search ..... 292/80, 84, 87, 292/19, DIG. 65

[56] References Cited

U.S. PATENT DOCUMENTS

| | | | |
|---|---|---|---|
| 2,765,208 | 10/1956 | Bush | 312/348 |
| 3,381,992 | 5/1968 | Friesen | 292/87 |
| 3,397,001 | 8/1968 | Friedman | 292/87 |
| 3,554,591 | 1/1971 | Rowe | 292/17 |
| 3,889,992 | 6/1975 | Shelton | 292/87 |
| 3,971,237 | 7/1976 | Rasmussen | 70/99 |
| 4,139,249 | 2/1979 | Hillman | 312/333 |
| 4,191,411 | 3/1980 | Rodgers | 292/87 |
| 4,378,948 | 4/1983 | Chrones | 292/19 |
| 4,416,477 | 11/1983 | Bialobrzeski et al. | 292/19 |
| 4,505,526 | 3/1985 | Leck | 312/333 |
| 4,632,438 | 12/1986 | McKinney | 292/87 |
| 4,715,628 | 12/1987 | Briak et al. | 292/19 |
| 4,717,184 | 1/1988 | Boyce | 292/87 |
| 4,919,464 | 4/1990 | Richards | 292/251.5 |
| 5,147,099 | 9/1992 | McLinden et al. | 292/175 |
| 5,226,201 | 7/1993 | Lefebvre | 16/86 A |
| 5,445,451 | 8/1995 | Harmony | 312/333 |

*Primary Examiner*—Steven N. Meyers
*Assistant Examiner*—Donald J. Lecher

[57] ABSTRACT

A mechanically operated latch includes a stop member and a restraining member which are disposable between an engageable position and a disengageable position. In which a restraining member (14) is displaceable between a first position in which an abutment surface is engageable with the stop member (18) which is attached to the cabinet frame to permit only limited opening movement of the panel and a second position in which the abutment surface is not engageable with the stop member to permit unlimited opening movement of the panel. The force required to activate the latch is such that it can be overcome by an adult but not by a small child.

6 Claims, 7 Drawing Sheets

ENGAGEABLE AND DISENGAGEABLE SAFETY LATCH

BACKGROUND

1. Field of Invention

The present invention relates to closure latches for cabinets, and more particularly to such latches that are intended to be child-resistant and earthquake proof during a tremor.

2. Description of Prior Art

Many closure latches have heretofore been devised for use on cabinet doors, drawers and other apparatus which are designed to allow partial opening of a drawer, door or the like, and which have a latch member which can be manually biased out of engagement to allow full opening of the drawer, door or the like. Examples of such latches are disclosed in U.S. Pat. Nos. 3,381,992 to Friesen (1968), and 3,397,001 to Friedman (1968), and 4,416,477 to Bialobrzeski, et. al. (1983), and 4,505,526 to Leck (1985).

It has often been found that previously known latches may not be nearly as child-resistant as someone using them might hope. While these latches may present obstacles for children attempting to gain access to the cabinet's interior, children, like adults, may be able to reach over the top of the closure panel and still gain access to the interior. Thus, in prior art child-resistant latches, the closure panel can be opened relatively widely with respect to the cabinet frame and the young child may gain access to the contents in the front portion of the drawer or cabinet even though he cannot activate the latch.

A further disadvantage of prior art child-resistant latches is that the closure panel must be opened a substantial amount to enable the adult operating the latch to place his finger on the upper surface of the restraining arm and have sufficient leverage to push the restraining arm downward to disengage the latch. The prior art child-resistant latches disclosed in the Friesen, Friedman and Leck patents show such a common disadvantage wherein the cabinet or drawer may be opened too far thereby exposing the contents before allowing the adult to press down on the top of the restraining arm to flex it downwardly to open the cabinet or drawer.

In many instances, it may be preferable to temporarily disable such a device when its usage is not required for an extended period of time, such as during the busy hour of cooking or other activities or, when small children are not present and to engage the device again when needed. Prior art latches are not disengageable once they are installed and the user is forced to make use of it, without a choice, every time he intends to open the drawer, door or the like.

OBJECTIVES AND ADVANTAGES

A principle objective of the present invention is to provide a child-resistant latch that overcomes these and other disadvantages previously associated with such devices.

(a) It is an objective of the invention to provide a safety latch assembly which is dependable in preventing accidental opening of a closure but which is readily moved to a latching position with little stress on the elements.

(b) It is another objective of this invention to provide a safety latch assembly which, when in latched position, is moved more firmly into latched position by pulling on the closure.

(c) It is another objective of this invention to provide a safety latch assembly which, when not intended to be employed as a latching device may be disengaged easily by the user.

(d) It is another objective of this invention to provide a safety latch assembly in which the opening of the closure panel, with respect to the frame, can be set by the user to any size opening, even as small as a credit card.

(e) It is another objective of this invention to provide a safety latch assembly in which a very limited opening of the closure panel protects the contents of the cabinet during an earth tremor.

Other features and advantages of the present invention will become more apparent from the following detailed description, taken in conjunction with the accompanying drawings which illustrate, by way of example, the principles of the invention.

SUMMARY OF THE INVENTION

The present invention provides a latch for restricting movement of a first article with respect to a second article when the first article is coupled to the second article for guided movement with respect to the second article, comprising: a support member for attachment to either the first article or the second article; a stop member for attachment to the other of the first article and the second article; and a restraining member coupled to the support member for engaging the stop member when the support member and the stop member are so attached to the first article and the second article that the restraining member engages the stop member when the first article is coupled to the second article for guided movement with respect to the second article and the first article is moved from a first given position to a second given position with respect to the second article; wherein when the first article is coupled to the second article for guided movement with respect to the second article and the first article and the support member and the stop member are so attached to the first article and the second article, the restraining member and the stop member are disposed in a relationship to one another that can be adjusted between an engageable relationship during which the restraining member engages the stop member when the first article is moved from the first given position to the second given position with respect to the second article and an unengageable relationship during which the restraining member does not engage the stop member when the first article is moved from the first given position to the second given position with respect to the second article.

In one embodiment of the present invention, the restraining member is pivotally mounted to the support member for movement between a position in which the restraining member is disposed in said engageable relationship with the stop member and a position in which the restraining member is disposed in said unengageable relationship with the stop member.

In another embodiment of the present invention, the restraining member includes a support plate and the support member includes a channel for receiving the support plate for disposing the restraining member in said engageable relationship with the stop member; and when the support plate is removed from the channel, the restraining member is disposed in said unengageable relationship with the stop member.

In a further embodiment of the present invention, the stop member includes a catch member having an engaging surface for said engagement with the restraining member and a guide plate for said attachment to the other of the first article and the second article; and the guide plate defines a groove in which the catch member is disposed for being moved between a position in which the restraining member is disposed in said engageable relationship with the stop member and a position in which the restraining member is disposed in said unengageable relationship with the stop member.

In all embodiments it is preferred that the restraining member is depressible in response to application of at least an adult-like force to a temporary position in which the restraining member does not engage the stop member while the restraining member is disposed in said engageable relationship with the stop member.

BRIEF DESCRIPTION OF THE DRAWINGS

In the drawings closely related figures have the same number but different alphabetic suffixes

REFERENCE NUMERALS IN DRAWINGS

FIGS. 1 thru 6

Figure 1:
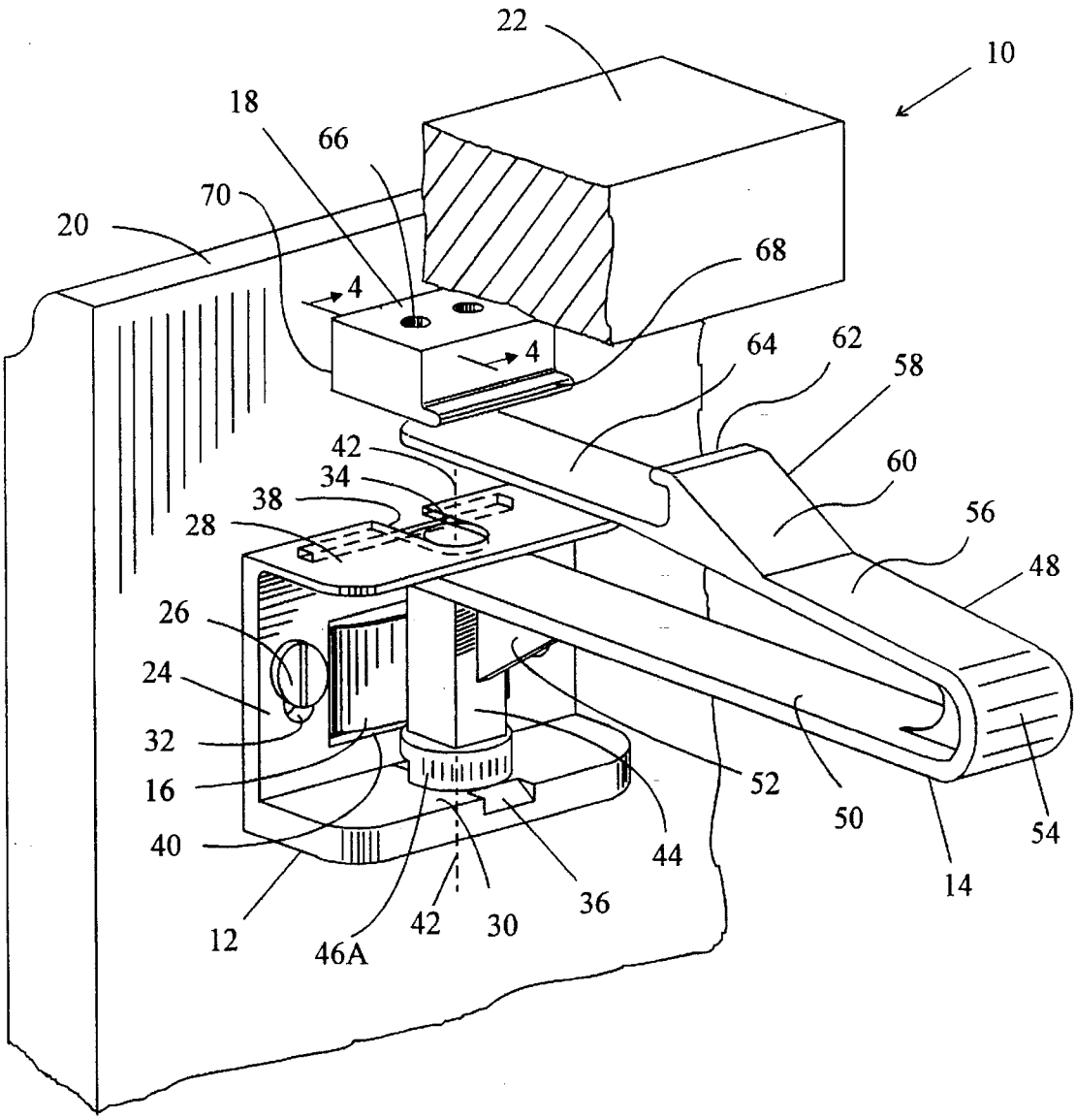
FIG. 1 is a perspective view of the latch constructed in accordance with the invention, and mounted in a cabinet (a fragmentary portion of which is illustrated), the latch engaging with the stop member affixed to the door jamb to limit opening movement of the door leaf.

10 latch
12 support member
14 restraining member
16 spring
18 stop member
20 door leaf
22 door jamb
24 mounting plate
26 mounting screw
28 upper support wall
30 lower support wall
32 screw slots
34 shaft hole
36 assembly guide
38 slot
40 spring chamber
42 axis
44 shaft
46 axis guide
46A axis guide
48 restraining arm
50 support arm
52 support ridge
54 apex
56 latching arm
58 abutting mechanism
60 cam surface
62 abutment surface
64 release lever
66 mounting holes
68 engaging surface
70 engaging surface

Figure 7:
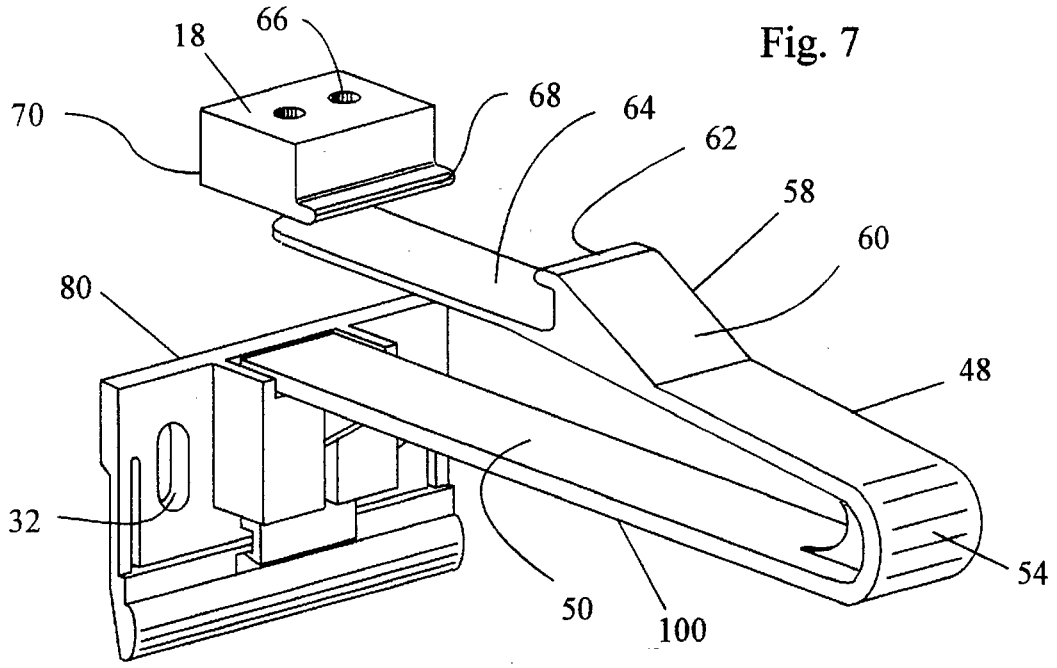
FIG. 7 is a perspective view of another form of the engageable and disengageable latch constructed in accordance with the invention, showing the restraining member demountably attached to the base.
Figure 7A:
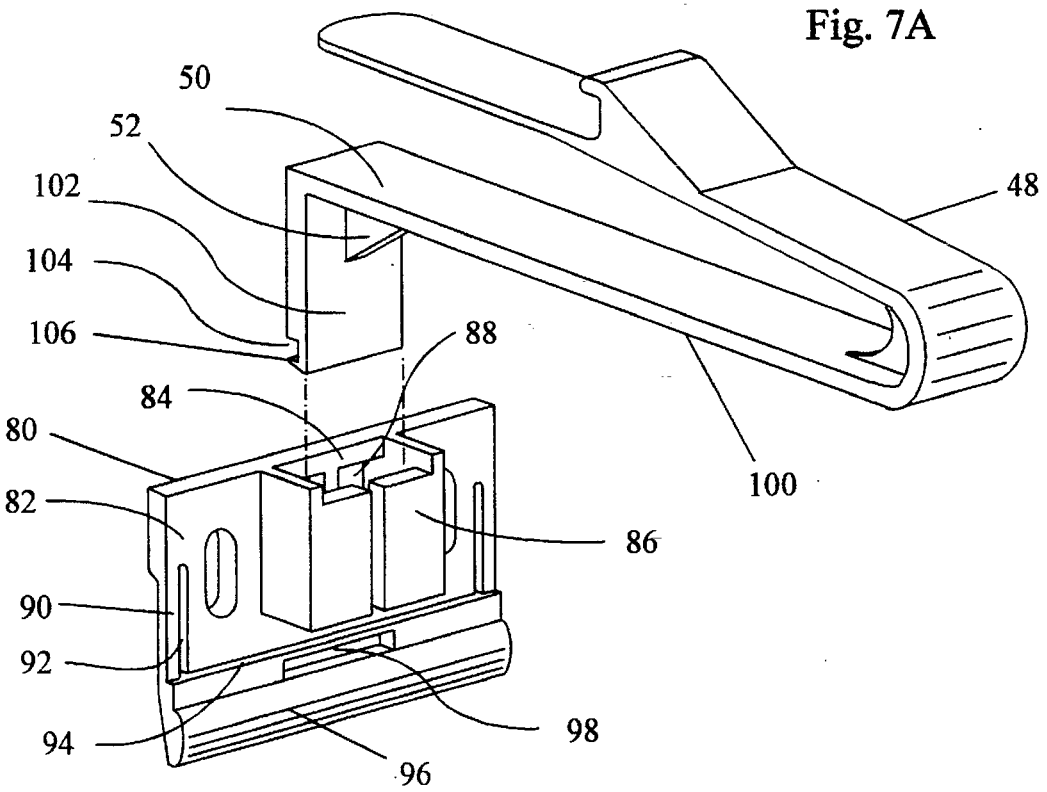
FIG. 7A is a disassembled perspective view of the embodiment of FIG. 7.

FIGS. 7 and 7A

80 support member
82 mounting base
84 guide channel
86 support flange
88 slot
90 spring bar
92 vertical slot
94 horizontal slot
96 release bar
98 locking slot
100 latch member
102 support plate
104 locking groove
106 locking lug

Figure 8:
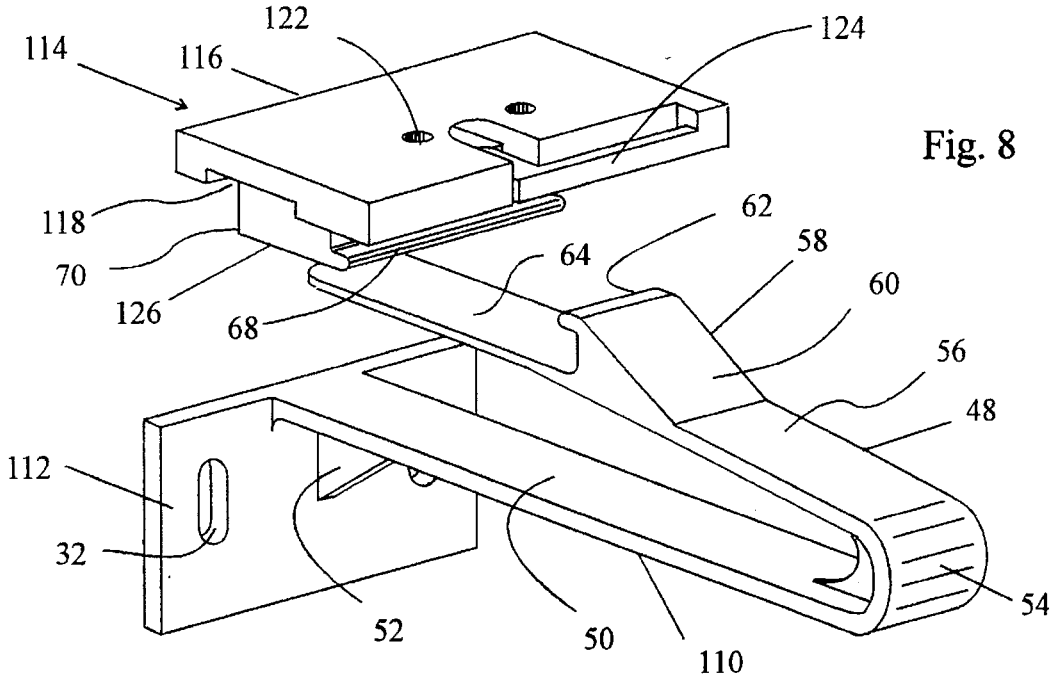
FIG. 8 is a perspective view of another form of the engageable and disengageable latch constructed in accordance with the invention, showing the restraining member fixedly attached to a door leaf, and the stop member that is attached to the door jamb is in a position to limit opening movement of the door leaf.
Figure 8A:
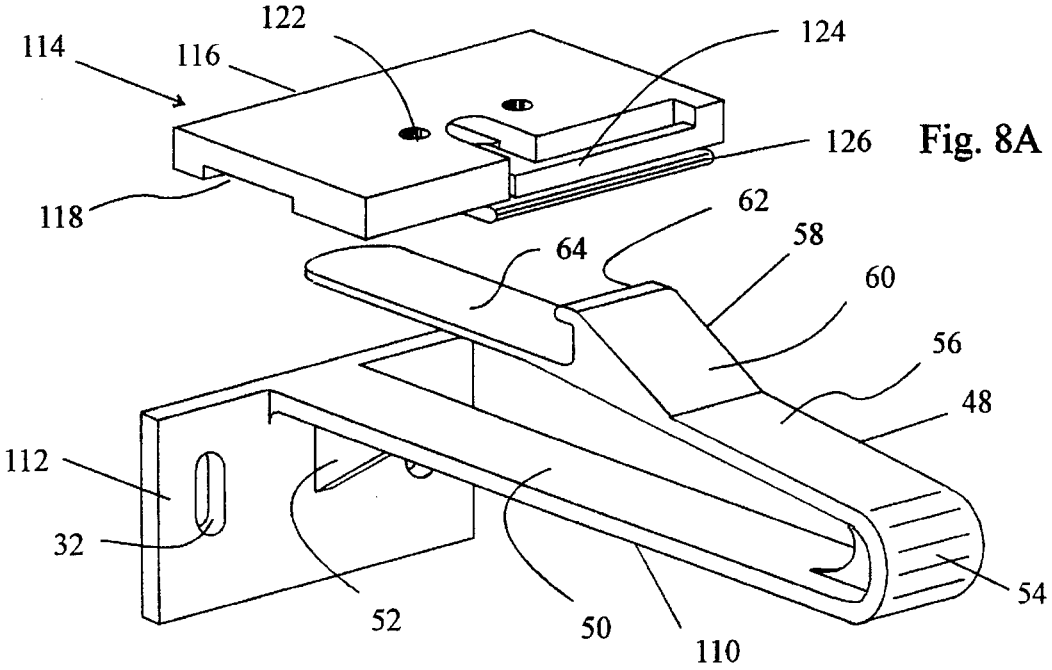
FIG. 8A is a perspective view of another form of the engageable and disengageable latch constructed in accordance with the invention, showing the restraining member fixedly attached to a door leaf, and the stop member that is attached to the door jamb is in a position to allow unlimited opening movement of the door leaf.
Figure 9:
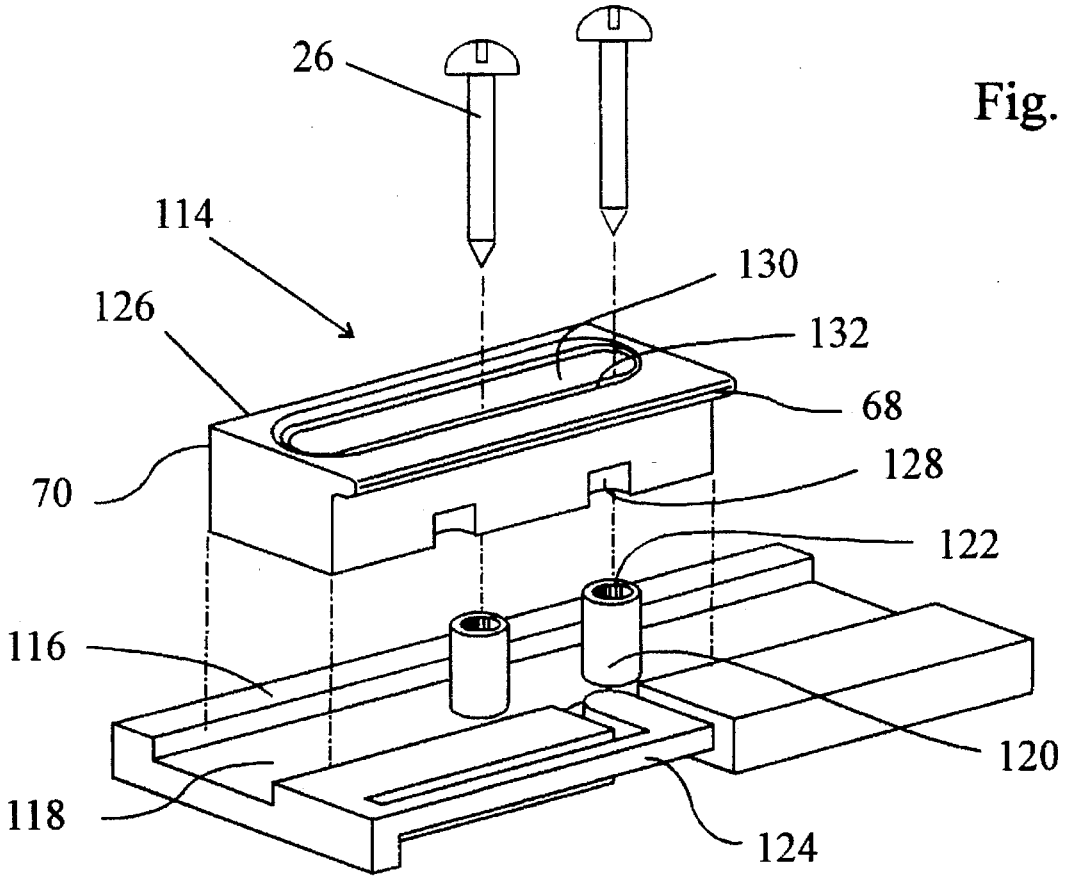
FIG. 9 is an exploded perspective view of the stop member of FIG. 8 constructed in accordance with the invention, as viewed from beneath with respect to FIG. 8.

FIGS. 8, 8A and 9

110 latch member
112 base plate
114 stop
116 guide plate
118 groove
120 post
122 support hole
124 detent lug
126 catch member
128 detent groove
130 elongated hole
132 recessed elongated hole

DESCRIPTION OF THE PREFERRED EMBODIMENT FIGS 1 THRU 6

An exemplary engageable and disengageable child-resistant latch 10 that embodies many aspects of the present invention, illustrated in the accompanying drawings, includes four basic components: a support member 12, a pivotable restraining member 14, a spring 16 and a stop member 18.

FIG. 1 shows a manually operated latch designed to be fixed to the normally inaccessible interior door side of a cabinet drawer or door leaves of, for example, article of furniture.

Figure 6:
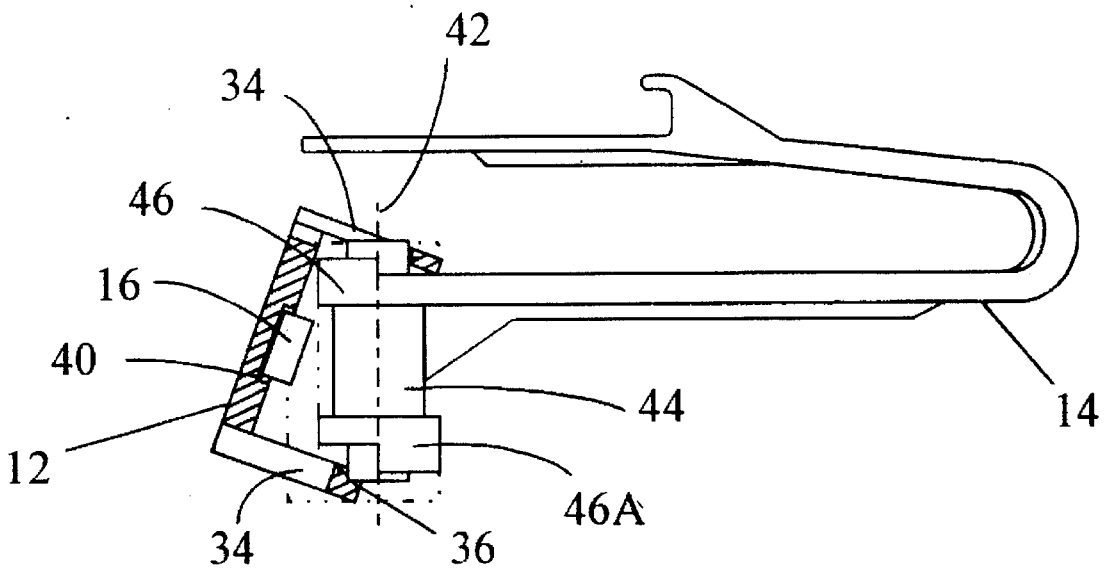
FIG. 6 is a plan view of the embodiment of FIG. 1 of the latch assembly, the restraining member being inserted into the support.

The latch 10 is shown attached to a door leaf 20 and includes the support member 12 secured by a plurality of mounting screws 26 to the door leaf 20, the restraining member 14, the spring 16 and the stop member 18. The support member 12 supports the pivotally mounted restraining member 14 that is pivotable about a vertical axis 42 so as to be able to engage or disengage with the stop member 18 mounted to a door jamb 22. The preferred embodiment of the support member 12 comprises a mounting plate 24, an upper support wall 28 and a lower support wall 30 which are attached perpendicular to the top and bottom of the support member 12, respectively, and facing away from the interior door leaf 20. The restraining member 14 resides between upper support wall 28 and lower support wall 30. The support member 12 has a plurality of screw slots 32 formed therein through which mounting screws 26 may be positioned for fastening the support member 12 to the door leaf 20. The slots allow positioning of the latch to properly engage the stop member 18. The upper support wall 28 and the lower support wall 30 each include an shaft hole 34 which is open towards the mounting plate 24 to facilitate the molding process. A slot 38 at the top center of the mounting plate 24, which partially separates the mounting plate 24 and the upper support wall 28 and in combination with an assembly guide 36, facilitates the assembly of the support member 12 and the restraining member 14, which is best shown in FIG. 6. The entire support member 12 in its preferred form is of one piece, of integrally formed molded plastic construction.

Figure 2:
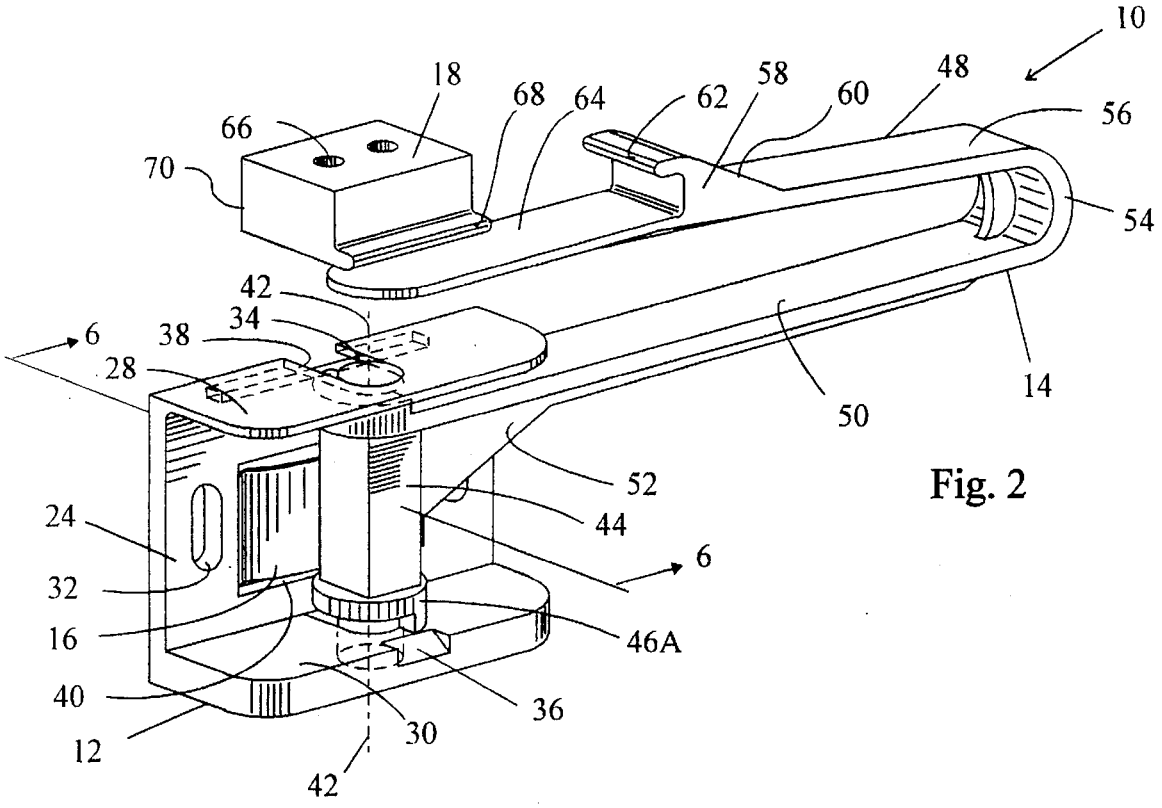
FIG. 2 is a perspective view of the latch in FIG. 1, with its restraining member moved to one side of the panel in its disengaged position.
Figure 3:
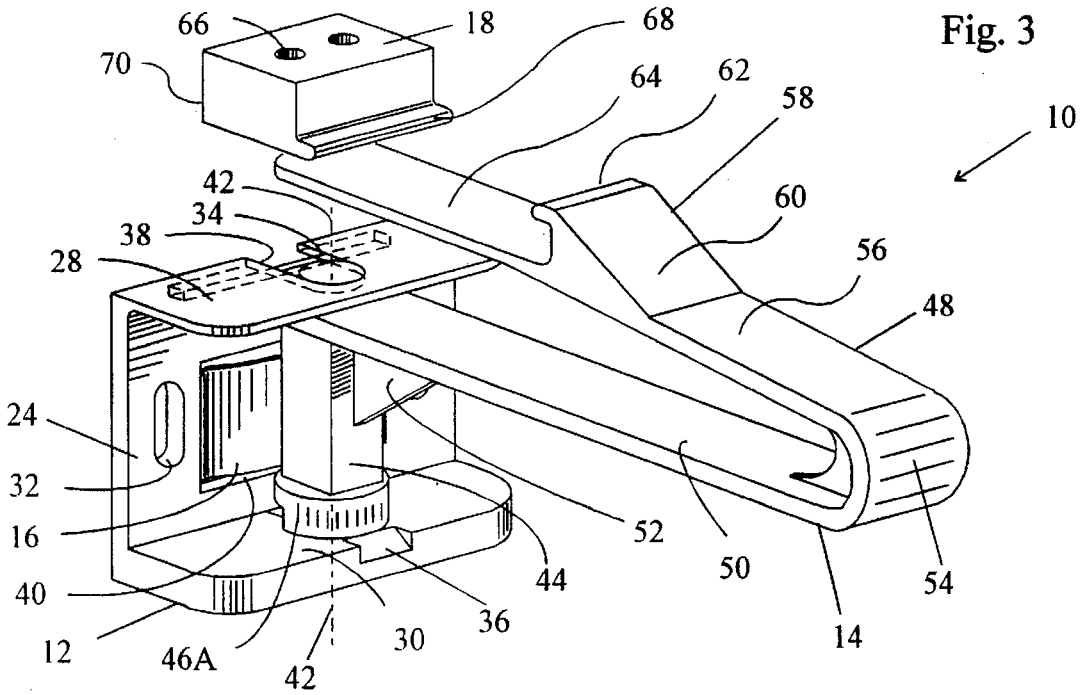
FIG. 3 is a perspective view of the latch in FIG. 1, with its restraining member moved perpendicular to the panel in its engaged position.

The preferred embodiment of the restraining member 14, which is best shown in FIG. 2 and FIG. 3, comprises the shaft 44 and a restraining arm 48. The shaft 44 is pivotally mounted with plain bearings in shaft holes 34 in the support walls 28 and 30 to define the vertical axis 42. The shaft 44 includes two cylindrically shaped axis guides 46 and 46A at opposite ends of the shaft 44. The axis guides 46, 46A are larger in diameter than the shaft holes 34, and supports the shaft 44 by resting against the mounting plate 24. One axis guide 46 is located below the upper support wall 28 and is above a support arm 50 which is connected to shaft 44, the second axis guide 46A is located above the lower support wall 30.

The shape of the axis guides 46, 46A are half cylindrical and facilitates the assembly process, which is best shown in FIG. 6. In addition, axis 42 includes a shaft 44 between both axis guides 46 and 46A. The preferred embodiment of the restraining arm 48 includes the support arm 50, a support ridge 52, an apex 54, a latching arm 56, an abutting mechanism 58 and a release lever 64. The abutting mechanism 58 includes a rising cam surface 60 that protrudes upwardly from the latching arm 56 and the L-shaped abutment surface 62.

The support arm 50, the latching arm 56, the release lever 64 and the apex 54 are preferably of rectangular-shaped cross-section. Both the support arm 50 and the latching arm 56 form a U-shaped assembly which are connected together at the apex 54. The apex 54 is rounded to ensure safe operation of the latch. The extension of the latching arm 56 forms the release lever 64 which extends to the plane of the mounting plate 24 at which point it is rounded to facilitate the turnability of the restraining member 14. The support ridge 52, increases the rigidity of restraining arm 48 and runs along the lower broad side perpendicular to the support arm 50 to form a T-shaped cross-section and is tapered narrowly at the apex 54. The abutting mechanism 58 is located at about center length of the latching arm 56.

The support arm 50 extends perpendicularly from the upper portion of axis 42 and is connected with reference to its broad side perpendicular to the direction of axis 42. The tapered support ridge 52 connects with reference to its broad side in the direction of axis 42 to the shaft 44.

The spring 16, preferably of leaf type, is imbedded in a spring chamber 40 which is recessed into the mounting plate 24 and resiliently biased against the flat surface of shaft 44 and predetermines the three possible positions of the restraining member 14, from which two are shown. The spring may be inserted into the spring chamber 40 after assembling the restraining member 14 and the support member 12, which is best shown in FIG. 6.

Figure 5:
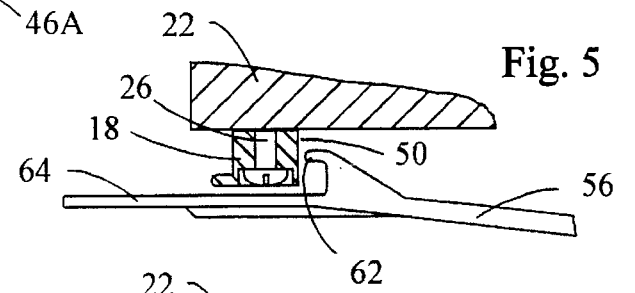
FIG. 5 is a sectional view of the embodiment of FIG. 4, showing the stop member configured in a position to ease the operation of the restraining member.

The stop member 18, preferably of rectangular shape, includes a plurality of recessed mounting holes 66 through which mounting screws 26 may be positioned for fastening the stop member 18 to the door jamb 22. It further includes an L-shaped engaging surface 68 and a flat engaging surface 70 located on opposite sides of the stop member 18 and are perpendicular to the mounting surface. The L-shaped engaging surface 68 is a mirror image of the abutment surface 62 and adds to the security of the child-resistant latch 10. The flat engaging surface 70 eases the operation, which is best shown in FIG. 5.

In the preferred embodiment of the invention, the restraining member 14 is made of a resilient plastic material such as nylon polypropylene, and is made in such proportion that it will deflect to some extent during operation of the latch. The entire restraining member 14 in its preferred form is of one piece, of integrally formed molded plastic construction.

DESCRIPTION OF THE PREFERRED EMBODIMENTS FIGS. 7 AND 7A

The version shown in FIGS. 7 and 7A differs from that shown in FIG. 1 in that the restraining arm 48 is demountably attached to the door leaf 20. This form of the engageable and disengageable latch constructed in accordance with the invention, includes three basic components: a support member 80, a demountably attached latch member 100 and the stop member 18.

The preferred embodiment of the support member 80 comprises a mounting base 82, on which surface facing away from the interior door leaf 20 is a vertical guide channel 84, formed by two opposing support flanges 86 of L-shaped cross-section.

At the bottom of the mounting base 82 is a release bar 96, which includes, at about its center length, a locking slot 98. On both sides of the release bar 96, is a spring bar 90 which is connected to the mounting base 82. The spring bar 90 and the release bar 96 are formed with molded vertical slots 92 and a horizontal slot 94, respectively. The spring bar and the release bar are narrower than the thickness of the mounting base 82 to accommodate for the deflection thereof.

A slot 88 in the mounting base 82, located behind each of the L-shaped support flanges 86, facilitates the molding process. The entire support member 80 in its preferred form is of one piece, of integrally formed molded plastic construction.

The preferred embodiment of the latch member 100, which is best shown in FIG. 7A, comprises a support plate 102 and the restraining arm 48. The support arm 50 of restraining arm 48 extends perpendicularly, facing away from the interior door leaf 20 (shown in FIG. 1) and from the upper portion of the support plate 102. The support ridge 52 connects perpendicular to support plate 102, facing away from the interior door leaf 20.

The support plate 102 is of rectangular-shaped cross-section and it includes a horizontal locking groove 104 and locking lug 106 at the side facing the interior door leaf 20. The entire latch member 100 in its preferred form is of one piece, of integrally formed molded plastic construction.

The support member 80 supports the latch member 100 that fits with its support plate 102 within the guide channel 84 so as to be able to engage with the stop member 18 mounted to the door jamb 22. The support member 80 has a plurality of screw slots 32 formed therein through which mounting screws 26 may be positioned for fastening the mounting base 82 to the door leaf 20. The slots allow positioning of the abutting mechanism 58 to properly engage with the stop member 18.

DESCRIPTION OF THE PREFERRED EMBODIMENT FIGS. 8, 8A AND 9

The preferred embodiment version shown in FIGS. 8, 8A and 9 differ from that shown in FIG. 1 in that the restraining arm 48 is fixedly attached to the door leaf 20 and the stop member is movably attached to the door jamb 22 to limit opening movement of the door leaf 20. This form of the engageable and disengageable latch constructed in accordance with the invention, includes two basic components: a latch member 110 and a stop 114. The preferred embodiment of the latch member 110, which is best shown in FIG. 8, comprises a base plate 112 and the restraining arm 48. The support arm 50 of restraining arm 48 extends perpendicularly from the upper portion of the base plate 112, facing away from the interior door leaf 20, which is best shown in FIG. 1. The support ridge 52 connects perpendicularly to the base plate 112 facing away from the interior door leaf 20.

The preferred embodiment of the stop 114, which is best shown in FIG. 9, comprises a guide plate 116 and a catch member 126 which includes an elongated hole 130 and a recessed elongated hole 132.

On the surface, along the center of the guide plate 116, facing away from the mounting surface is a rectangular shaped groove 118 in which the catch member 126 resides. In the groove 118 are a plurality of cylindrically shaped posts 120 of suitable size to move freely within the elongated hole 130. The post 120 includes in their center a support hole 122 through which mounting screws 26 may be positioned for fastening the stop 114 to the door jamb 22. A detent lug 124, which is integrally formed within the guide plate 116, protrudes into the groove 118 to detent the catch member 126 which includes a plurality of detent grooves 128. The catch member 126 further includes the L-shaped engaging surface 68 and the flat engaging surface 70 located on opposite sides of the stop member and perpendicular to the mounting surface. Guide plate 116 and the catch member 126 are each made of one piece, preferably of integrally formed molded plastic construction.

OPERATION

FIGS. 1 Thru 6

The operation of one embodiment of the child-resistant latch will now be described with respect to FIGS. 2, 3, 4, 4A, 5 and 5A. FIG. 2, shows the restraining member 14 in a position so it will not be able to engage with the stop member 18, and allows unlimited movement of the cabinet door leaf 20. Referring to FIGS. 2 and 3, moving the pivotally mounted restraining member 14 from a parallel position to a perpendicular position with respect to the door leaf 20, allows the user to engage the latch and therefore prevent further opening of the door.

Figure 4:
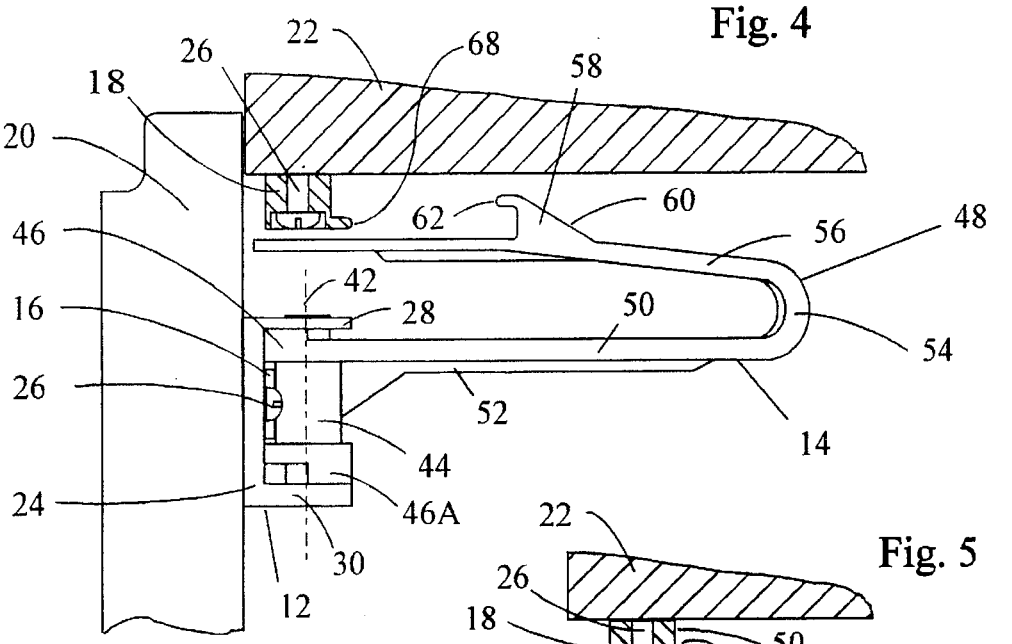
FIG. 4 is a plan view of the embodiment of FIG. 1, shown installed on a door leaf with its restraining member in the engaged position.
Figure 4A:
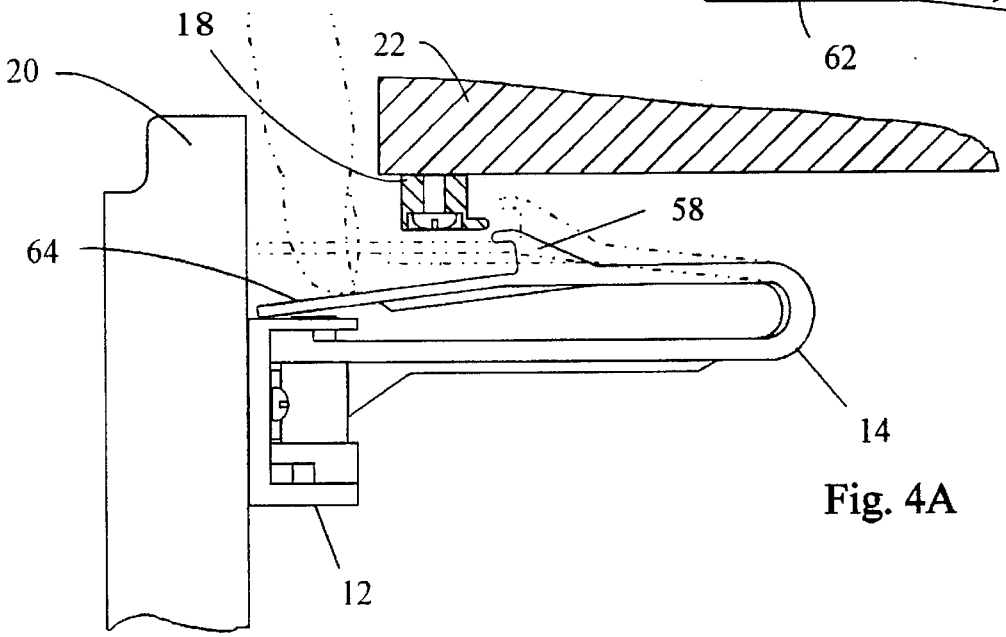
FIG. 4A is a plan view of the embodiment of FIG. 4, showing the embodiment in the position that it assumes upon attempted opening of the door leaf.

Referring to FIG. 4, the figure shows the door leaf in the closed position. A person seeking to open the door leaf 20 moves the door from the position shown in FIG. 4 to the position shown in FIG. 4A. When the door leaf 20 has been moved outwardly, with respect to the door jamb 22, a predetermined distance, the abutment surface 62 and the L-shaped engaging surface 68 meet and prevent further opening of the door. As shown in FIG. 4A, a finger has been inserted into the interior of the cabinet so that the finger touches the release lever 64. To release the latch, the door leaf 20 is pushed in the direction of the door jamb 22 until the abutment surface 62 disengages again from the stop member 18, which allows the latch to release and enables the adult to have full access to the cabinet interior.

The abutment surface 62 engages with the stop member 18 during attempted opening of the door leaf 20, whereas the inclined cam surface 60 engages with the stop member 18 upon closing movement of the door leaf 20 to force the latching arm downwardly to re-arm the latch. Installing the stop member 18, in such a way, where the flat engaging surface 70 faces the abutment surface 62, which is best shown in FIG. 5, eases the operation in cases where this feature is preferred.

Figure 5A:
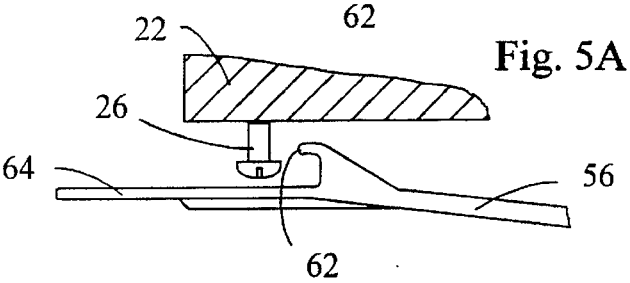
FIG. 5A is a sectional view of the embodiment of FIG. 4, showing the stop member being a screw.

The operation of the latch does not depend on the stop member 18 and may be eliminated altogether and replaced by the mounting screw 26, which is best shown in FIG. 5A.

FIGS. 7 and 7A

The embodiment shown in FIGS. 7 and 7A differs from that shown in FIG. 1 in that the restraining arm 48 is demountably attached to the support member 80. This allows the user to quickly detach and re-attach the latch member 100, whereby the user enables or disables the engagement of the latch with the stop member 18.

During re-attachment, the support plate 102 inserts into the guide channel 84 and its locking lug 106 deflects the release bar 96. Once the locking lug 106 approaches the locking slot 98, the resilient force of the spring bar 90 will lock the latch member 100 into place.

FIGS. 8, 8A and 9

The embodiment shown in FIGS. 8 and 8A differs from that shown in FIG. 1 in that the restraining arm 48 is fixedly attached to the door leaf 20 and a movable stop 114 is attached to the door jamb 22 to limit opening movement of the door leaf 20. The movable catch member 126 allows the user to quickly engage or disengage the latch member 110. The detent lug 124 in combination with detent groove 128 secures the catch member 126 in preset positions, to enable operation between an engaged position and a disengaged position.

CONCLUSION, RAMIFICATIONS, AND SCOPE

It can be seen that the present latch provides a child-resistant safety latch with the feature to temporarily disable the device with little effort from the user.

While my above description contains many specificities, these should not be construed as limitations on the scope of the invention, but rather as an exemplification of one preferred embodiment thereof. Many other variations are possible. Thus the scope of the invention should be determined not by the embodiment(s) illustrated, but by the appended claims and their legal equivalents.

What is claimed:

1. A latch comprising:

a stop member for latching said latch;

a mechanical latching means for latching engagement with said stop member, said latching means having an apex portion and a support arm that extends away from said apex portion and a latching arm that extends away from the opposite side of said apex portion, said support arm and said latching arm are substantially parallel to each other, wherein said support arm is substantially rigid, said latching arm having an abutting mechanism about the center length of said latching arm thereon, wherein said abutting mechanism having an inclined cam surface facing said apex and an abutment surface facing away from said apex, said latching arm having a flexible portion between said cam surface and said apex and a substantially rigid release lever portion extending out from said abutment surface, said latching arm having a first position in which said abutment surface is engageable with said stop member and a second position in which said abutment is not engageable with said stop member;

pivot means for pivotally mounting said latching means to a support thereon, wherein said abutting mechanism is pivotable about said pivot means between a latchable position where said abutting mechanism engages said stop member and an unlatchable position where said abutting mechanism does not engage said stop member;

spring means disposed between said support and said pivot means for resiliently biasing said restraining member in a predefined engageable position, and in a predefined position which is not engageable with said stop member.

2. A latch according to claim 1, wherein said stop member includes a plate receptive to fastener means, said stop member includes a plurality of engaging surfaces to engage with said abutment surface.

3. A latch according to claim 2, wherein said support further comprises two support walls which are substantially parallel to each other and substantially perpendicular to a mounting plate, and between which said latching means is pivotally mounted between said walls for turning about an axis which is substantially perpendicular to said walls;

said axis is substantially perpendicular to said support arm and opposite said apex of said latching means, and said mounting plate includes apertures receptive to fastener means.

4. A latch according to claim 3, wherein said abutment surface includes a lug to engage with said engaging surface;

said abutment surface faces said axis adapted for attachment to said latching arm;

wherein said latching arm includes said release lever by which a force can be applied to move said latching arm and said abutment mechanism from a latching position to an unlatched position, wherein the movement from a first position to a second position of said latching arm is substantially in the direction to said support arm.

5. A latch according to claim 3, wherein said spring means biases said pivot means, wherein said spring means resides between a recessed surface portion of said mounting plate and a substantially square portion of said pivot means.

6. A latch according to claim 1, wherein a fastener means takes the place of said stop member to engage with said latching means.

* * * * *